US009085195B2

(12) United States Patent
Mesaros

(10) Patent No.: US 9,085,195 B2
(45) Date of Patent: Jul. 21, 2015

(54) THREE-DIMENSIONAL ART AND TOOL FOR CREATION OF THE SAME

(76) Inventor: Francis Mesaros, Sebastian, FL (US)

( * ) Notice: Subject to any disclaimer, the term of this patent is extended or adjusted under 35 U.S.C. 154(b) by 872 days.

(21) Appl. No.: 13/291,617

(22) Filed: Nov. 8, 2011

(65) Prior Publication Data

US 2012/0128884 A1 May 24, 2012

Related U.S. Application Data

(60) Provisional application No. 61/415,502, filed on Nov. 19, 2010.

(51) Int. Cl.

| | |
|---|---|
| ***B44B 11/00*** | (2006.01) |
| ***B44C 3/04*** | (2006.01) |
| ***B44D 2/00*** | (2006.01) |
| ***B44D 3/00*** | (2006.01) |

(52) U.S. Cl.

CPC ..... *B44B 11/00* (2013.01); *B44C 3/046* (2013.01); *B44D 2/005* (2013.01); *B44D 3/00* (2013.01)

(58) Field of Classification Search

CPC ..... B44D 2/005; B44D 3/162; B44D 3/164; B44D 3/225; B05C 17/10

USPC ..... 427/277, 288

See application file for complete search history.

(56) References Cited

U.S. PATENT DOCUMENTS

| | | | | |
|---|---|---|---|---|
| 2,099,030 | A | 11/1937 | Morrison | 41/26 |
| 3,287,193 | A | 11/1966 | Klein | 156/59 |
| 6,134,743 | A * | 10/2000 | Schmidt | 15/236.01 |
| 6,228,427 | B1 | 5/2001 | Wanger | 427/258 |

OTHER PUBLICATIONS

'How to Use a Palette Knife'. Uploaded on Apr. 14, 2010 [retrieved on Sep. 22, 2014]. Retrieved from the Internet: <URL: http://www.youtube.com/watch?v=93mDFg4YYwU>.*

'Creating Texture: Large Painting Knives & Acrylic Gels'. Uploaded Oct. 15, 2008 [retrieved on Sep. 22, 2014]. Retrieved from the Internet: <URL: http://www.youtube.com/watch?v=SqfokuRs4X8>.*

* cited by examiner

*Primary Examiner* — Alex A Rolland

(74) *Attorney, Agent, or Firm* — Winston & Strawn LLP

(57) ABSTRACT

A trowel for use in painting or sculpturing and having a handle enabling a user to hold the trowel, a rotating mechanism supported by the handle and an application member removably attached to and in rotary union with the rotating mechanism. The invention relates to a method for creating a three-dimensional artistic creation on a support member, with the method including distributing an image creating material on a palette, removing first portions of the image creating material and applying the image creating material with pressure across a path along and onto the support member with a twisting movement. Such application results in the first portions forming deposited panels that protrude from the support member at a thickness that is greater than that of the material on the palette. The invention also relates to a kit that includes a plurality of trowels with various size blades and image creating material.

20 Claims, 5 Drawing Sheets

THREE-DIMENSIONAL ART AND TOOL FOR CREATION OF THE SAME

This application claims the benefit of application Ser. No. 61/415,502 filed Nov. 19, 2010, the entire content of which is expressly incorporated herein by reference thereto.

BACKGROUND

The present invention relates to a method of preparing three dimensional artistic creations. The invention also relates to a tool for use in painting or sculpturing applications wherein an artistic creation is made by applying or removing material with rotation of the artist's wrist. The present tool facilitates this operation without requiring the artist to rotate his or her wrist, thus avoiding fatigue or injury.

Artists have had a long felt need for adding depth to two dimensional paintings. Typically, this was accomplished by placing thick layers or large gobs of paint onto the canvas. Some artists have developed complex tools and methods to help them create three dimensional paintings by the addition of depth to conventional two dimensional paintings.

U.S. Pat. No. 3,287,193 discloses a method of creating three dimensional paintings by molding dies based upon the surface of a professionally done painting. The dies are then placed in a press and a clean sheet of canvas is inserted in-between. By utilizing a die with a positive copy and another with a negative copy of the original painting, when the dies are pressed together, the surface characteristics of the original painting are transferred to the clean sheet of canvas. Thus, depth is added so that an artist does not need to layer the paint onto the canvas to create the same effect.

U.S. Pat. No. 2,099,030 discloses a method of painting utilizing rubber spatula-type painting tools. Larger quantities of paint are applied to a surface using these rubber spatula-type tools to deposit brush-like strokes that deposit greater thicknesses of paint.

U.S. Pat. No. 6,228,427 discloses a process for producing three dimensional images by placing raised sculpted pieces on a surface, and then applying paint over the surface.

Other techniques for adding depth are known. For example, the texturing of paint provides a nominal level of depth. Layering can also provide additional depth, by utilizing multiple layers of paint to build up a surface which protrudes from the surface of the painting. Thus, depth is created through the application of multiple paint layers to a canvas.

In general, these processes can be time consuming, undesirable and inaccurate. Modifying the canvas shape may not be an ideal solution, as it requires extra steps. Additionally, for some, it may be difficult to transfer the desired image to a piece of unpainted canvas by modifying the contours of the canvas. Layering also presents problems, as paint layers must be sufficiently dry prior to application of another layer. Unless desired, failure to do such will result in mixing of the layers and the combining of different colors. Especially for oil paints, as applying subsequent layers without allowing the prior layer to cure will result in a longer cure time for the painting. Furthermore, the painter may loose track of his or her artistic thought while waiting for the layer to dry. Thus a painter may get lost in their own work, losing motivation and resulting in a less desirable painting.

Thus there is a demonstrated need for adding depth to two dimensional paintings without needing to modify the canvas prior to painting. The present invention now satisfies this need.

SUMMARY OF INVENTION

The invention relates to a method for creating a three-dimensional artistic creation on a support member, which comprises: distributing an image creating material on a palette at a first substantially uniform thickness, removing first portions of the first thickness of image creating material from the palette and applying the first portions of the image creating material with pressure across a first path along and onto the support member with a twisting movement. Such application results in the first portions forming deposited panels that protrude from the support member at a thickness that is greater than that of the thickness of the material provided upon the palette. The discrete panels can be applied in a predetermined pattern to provide unusual and interesting three dimensional characteristics to the creation.

Another aspect of the method includes distributing further image creating material on a palette at a second substantially uniform thickness that is greater than that of the first substantially uniform thickness and removing second portions of the second thickness of image creating material. Applying the second portions of image creating material with pressure onto the support member is again done with a twisting movement. Such application results in the second portions being applied to protrude from the support member at a thickness that is greater than that of the material on the palette, as well as being greater than that of the first portions to provide three-dimensional features of the creation.

Yet another aspect of the method includes further repeating of the distributing and removing steps to create increased thicknesses of material on the support member. Each of the steps utilize increasing thicknesses of image creating material on a palette and with application of further portions to protrude from the support member at thicknesses that are greater than that of previously applied portions. This aspect of the present method provides further enhanced three-dimensional features of the creation.

To ease and speed up the application of the image creating material to the support member, the material may be applied by conventional trowels or blades. Application with trowels is generally done by scraping image creating material off the palette with the bottom of the trowel blade, and applying the image creating material to the support member using the bottom of the trowel blade as well. Generally, the greater thicknesses of material are applied using successively larger tools to more easily apply the materials to the support member.

A further aspect of the method of the invention utilizes guide lines upon the support for assisting in the application of the materials along the paths. Such guide lines are one or more generally horizontal lines, one or more, and preferably at least two, generally vertical lines or combinations of generally horizontal and generally vertical lines. These guide lines may also diverge from a point established on the support member. Advantageously, the guide lines include at least one horizontal line that shows where to apply a top row of deposited panels and a plurality of angled lines beneath the horizontal line. The preferred guide lines also include two downwardly extending angled lines that define an increasing size of a deposited panel on the support member so that further applied rows below the top row include increased size panels. The method of the invention also enables the second portions to be applied subjacent to the first portions and aligned therewith. By applying the second portions at least partially upon the previously applied first portions, the three-dimensional features of the creation are further enhanced.

The method of the invention preferably uses an oil-based artist's paint, acrylic-based artist's paint, a thermosetting polymeric material such as an epoxy or polyurethane, plaster of paris or modeling clay as the image creating material. The method may also use either the oil-based artist's paint or the acrylic-based artist's paint combined with a thermosetting polymeric material and colloidal silica. Additionally, it is also preferred to use a painter's canvas as the support member. Furthermore, it is advantageous to utilize the new painting or sculpturing tool described herein to facilitate application of the image creating material.

This new painting or sculpturing tool represents another embodiment of the invention. This tool is a trowel comprising a handle enabling a user to hold the tool, a rotating mechanism supported and enclosed by the handle and an application member attached to and in rotary union with the rotating mechanism.

The application member itself is an elongated member having first and second ends with a blade or trowel associated therewith on one end and a connection member associated with the other end. The connection member is configured and dimensioned to be received by the rotating mechanism for attachment thereto.

The handle is hollow and encloses the rotating mechanism at least partially or fully therein. Additionally, the handle is provided as first and second halves to facilitate assembly of the tool. Furthermore, the handle provides support for the rotating mechanism and application member. An embodiment of the application member allows it to be removable such that different size applications members can be connected to the handle and used to sequentially apply greater amounts of material. Alternatively, a number of tools, each with a different size application member, can be provided in a kit which the artist can use in preparing his or her artistic creation.

The rotating mechanism comprises a gear set having a first gear that is configured and dimensioned to receive the application member; and a second gear operatively associated with the first gear for rotating the first gear. Additionally, the rotating mechanism further comprises a trigger which is movable between first and second positions. A shaft is provided for mounting the second gear and spring for returning the trigger to the first position. To enable the spring to return the trigger to its first position, one end of the spring is mounted to the handle whereas the second end may be mounted to the first or second gear or the trigger itself. The trigger is attached to the second gear of the gear set such that movement of the trigger from its first position to its second position causes the gear set to rotate and the spring to deflect. Thus, after such movement, the spring returns the trigger to its first position making the tool ready for the next application of material.

The invention also provides for a kit for creating three-dimensional artwork. The A kit for painting comprises a plurality of trowels with various size blades; at least one handle for the trowels and a supply of image creating material. The kit specifically comprises 2 to 8 trowel blades of different size blades, with each mounted on its own handle or being configured for replaceable mounting on a single handle. Each handle preferably includes a rotating mechanism comprising a trigger which is operatively associated with a gear set, wherein each blade of the trowel is configured for attachment to and in rotary union with another gear within the gear set, such that movement of the trigger rotates the trowel blade. The image creating material can be a supply of paint, polymeric materials, clay, plaster of paris, similar materials, or combinations thereof, preferably with the materials having different colors for creating a desired scene, such as an ocean or sea view. The kit further comprises instructions for creating an image or artistic work, with the instructions provided in written form, audio form, video form and any combination thereof.

DETAILED DESCRIPTION OF THE PREFERRED EMBODIMENTS

Figure 1:
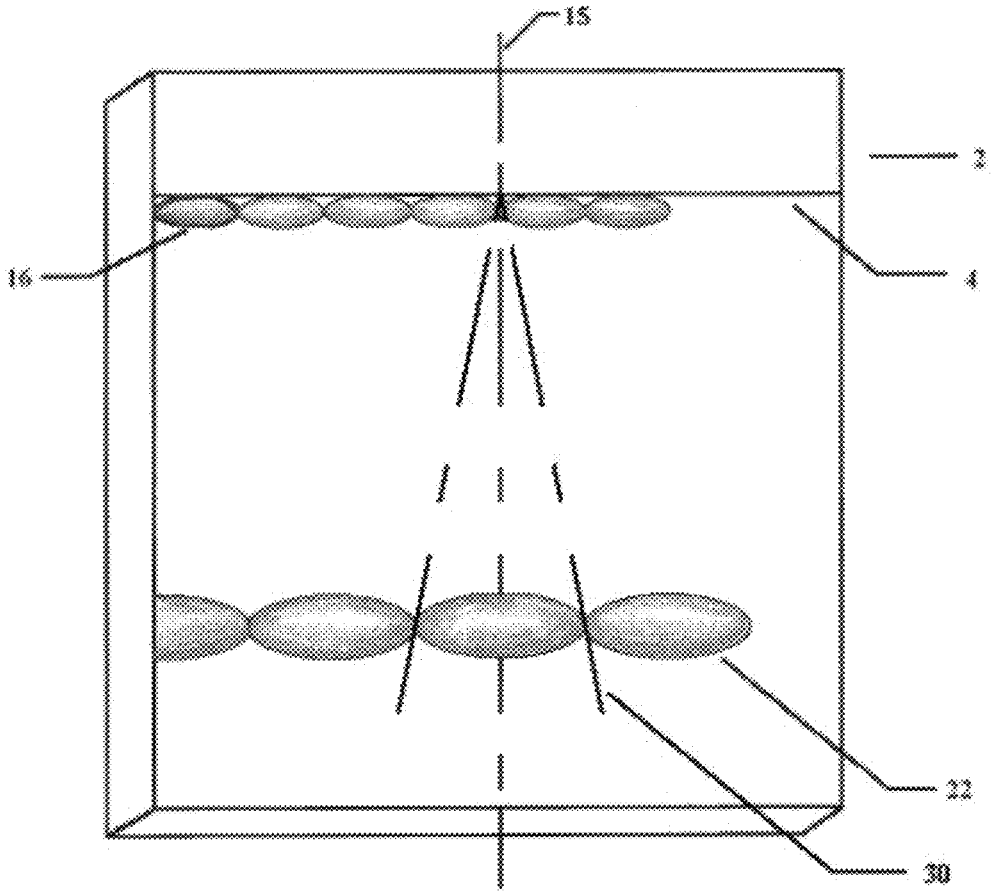
FIG. 1 is a perspective view of an artist's canvas marked with guide lines for applying paint panels according to the methods of the present invention.

The method of the present invention utilizes a novel approach to creation or artistic works such as paintings, sculptures and the like. While tools such as painting and sculpturing trowels have existed in the art for other uses, the method of the present invention utilizes a specially designed tool that provides a rotating or twisting action to pick up image creating material and then apply it to a support member. This method is referred to as a PANCTURE technique. The technique specifically refers to painting, sculpting or otherwise depositing panels of image creating material onto a support member to create a three dimensional painting.

The term "image creating material" is used herein to mean any material that can be applied or shaped to form an image. Typical image creating materials include: paint, clay, plaster of paris or other color providing or shape retaining material.

As used herein, the term "support member" is used in a general sense to include any plate, sheet, fabric, metal, wall, floor, ceiling, roof or other construction that can hold or support an image creating material. Typically, a canvas will be the usual support material for a painting while a stand or the like would be used to support a sculpture.

A preferred embodiment of the method includes sequentially applying discrete panels of paint or other image creating material in a pattern to create a three dimensional painting. The method comprises distributing paint on a palette at a first substantially uniform thickness, removing first portions of the first thickness of paint and applying such first portions across a first path along and onto a canvas with pressure and a twisting movement. Doing so causes the first portions to form deposited panels that protrude from the canvas at a thickness that is greater than that of the material on the palette. Therefore, depth is added to a painting, resulting in a three dimensional painting.

The term "palette" as used herein is a flat structure that can retain image creating material prior to application of that material to the support member. As disclosed herein, the material is initially applied to the palette at a substantially uniform thickness before being transferred onto the support member.

To prepare a painting, the artist typically begins by providing a supply of paint from a tube or other inventory. The paint is mixed to the desired consistency and color. Oil paint is frequently used by artists although in the present invention acrylics or curable coating materials such as epoxies can also be used, especially for the application of thicker material. The epoxies may also be mixed with conventional paints to aid in curing. Conventional additives can be provided to thicken the paint or coating material, with colloidal silica often being used. Drying additives are preferably used for applying thicker panels. A supply of paint of the desired properties is placed upon the palette, usually in a heap or pile. According to the invention, the paint is then smoothed out upon the palette with a trowel into a layer of uniform thickness.

As shown in FIG. 1, a canvas 2 is prepared by providing guide lines to assist the artist in applying the panels of paint in a desired pattern. For simplicity, FIG. 1 illustrates one horizontal guide line 4, one vertical guide line 15, two angled generally horizontal guidelines 33 and 35, and two angled vertical guidelines 30 to facilitate the depositing of larger panels beneath the horizontal guide line 4. Depending upon the desired creation, the guide lines are placed to help the artist center or arrange the deposited panels to achieve the desired effect.

The most important guide lines are the horizontal lines which are spaced at an increasing amount in a descending manner to properly increase the size of the panels of paint in order to obtain a three-dimensional effect in the painting. If an ocean view, for example, is to be depicted, the horizontal guide line 4 can represent the horizon, and the vertical guide line 15 can be provided in the center of the canvas representing the center of the artistic creation. Angled horizontal guide lines 33 and 35 can be used if desired for arranging additional rows of panels on the canvas. These angled lines can instead be essentially horizontal or if desired combinations of angled horizontal and essentially horizontal lines can be used. Vertical guide lines 30 may be present to define the widths of the deposited panels so that each panel deposited beneath the horizontal guide line 4 or along the additional generally horizontal lines 33 and 35 subjacent to the horizontal line is of increasing width. As shown, in addition to the horizontal line 4 that shows where to apply the top row of deposited panels, the two downwardly extending angled vertical lines 30 can be provided to help define an increasing size of a deposited panel on the support member for the further applied rows. The deposited panel may be applied at an angle as shown by panel 34. Upon completion, this effectively provides the lower portion of the support member with the larger deposited panels so that a viewer of the work appears to be more closely positioned to the bottom and further away from the upper portion of the work. A greater number of guide lines may be provided to assist a less experienced painter, while those with more familiarity with the present method find that only the horizontal lines are needed.

The artist then, using the bottom of the blade of a trowel, smoothes out a relatively thin layer of paint on the palette. A relatively small trowel can be used to pick up the paint from the palette, by using the bottom of the trowel blade, and then to transfer it in panels 16 along the guide line 4 in sequential left to right depositions, with the artist rotating the trowel to deposit the paint upon the canvas using pressure and a twisting motion so that the paint is applied as a panel at a thickness that is greater than what it was on the palette. The bottom of the trowel blade lays the paint flat upon the canvas while the artist pulls the trowel in a downward direction, applying pressure and rotation. The paint is squeezed under the trowel blade to protrude the paint forward so that it stands up on the canvas like shelf mushrooms at the base of a tree. The movement of the trowel against the canvas as described wipes the paint off the tool and applies it as a thick panel. The initial panels are applied in a horizontal row along the horizontal guide line 4. The initial panels are small to signify far away distances, e.g., the distance at the horizon of the ocean.

Next a slightly larger thickness of paint is applied to the palette. There is a particular measure of thickness needed in order to accommodate the guidelines that have been prepared. And a skilled artisan will immediately recognize that as the painting proceeds, the additional horizontal rows will generally be made with larger paint panels to provide the effect of a larger three dimensional structure depicting the closer perspective of the ocean to the viewer of the creation. As shown in FIG. 1, the lower application of panels 34 are much larger than panels 16 applied upon the line representing the horizon. As noted, guidelines 30 are utilized to ensure a uniform and gradual size increase between upper panels 16 and lower panels 34. The painting proceeds from the top guide line 4 to the bottom of the canvas. If desired by the artist, angled horizontal guidelines 33 and 35 can be used to determine placement of the panels as the painting proceeds from the top to the bottom. Different colors can be used to signify currents, waves or other sea anomalies. Of course for other depictions, different colors or three dimensional sizes can be used. Another preferred embodiment of the method of the invention repeats these steps as often as necessary, while gradually increasing the thickness of the paint on the palette, which also increases the thickness of the paint when applied to the canvas.

Yet another preferred embodiment of the method of the current invention also utilizes different size trowels. The first portion of paint of the first thickness can be applied to the canvas using the smallest trowel. As more portions of greater thickness are applied, the trowel size can be increased to ease the application of paint to the canvas.

The method of the invention preferably partially overlaps each portion of paint on the canvas during the sequential deposition. This is done both in the horizontal application of the panels as well as when the next subjacent row of panels is applied. While this overlapping is not mandatory, doing so further enhances the depth provided by the paint, and thus provides a greater height difference and higher quality three dimensional painting.

A skilled person in the art would recognize that the increasingly larger panels would present a problem of curing. As the panels increase in size, their curing time would increase dramatically to the point where they may not even fully cure. Furthermore, the paint may lack the required thickness to adequately apply it to the canvas, as panel sizes increase. Thus an embodiment of the method combines additives with the paint to remedy these problems. These additives help to not only cure the paint but also to thicken the paint to ease application of it onto the canvas. Utilizing oil-based or acrylic-based paints, the artist would combine either type of paint with a thermoset polymeric material and colloidal silica. For example, an artist using the method may decide to use oil-based paint, and would mix desired parts of paint, epoxy resin, hardener and colloidal silica. Of course a person of ordinary skill would recognize the necessary amount of each component needed, based upon the outcome they desire. For example, a longer cure time may utilize less hardener. For the use of acrylics, the amount of each component needed would be selected to create a thicker final product. Other thermosetting materials, such as two component polyurethanes, with or without fillers such as talc, colloidal silica or another inorganic material, can also be used.

The guidelines can also be used to determine the size of the paint portions or panels to be applied. It would be recognized that as these lines are meant to guide an artist, their placement and arrangement are determined solely by the artist, in order for the artist to obtain a certain effect in their work.

A preferred embodiment of the tool of the present invention is a painting or sculpturing tool, which has a handle enabling a user to hold the tool, a rotating mechanism supported by the handle and an application member removably attached to and in rotary union with the rotating mechanism. Incidentally, the preferred embodiment of the invention has a trowel as the application member, but it is understood that this application member can be any one of a variety of blades, spatulas or other application tools which are conventionally used by artists, specifically painters or sculptors for other purposes.

The preparation of a painting as described above can be facilitated by the use of a tool in accordance with the further embodiment of the invention. This tool is a trowel that is made with particular features as described herein. On one end of the application member is the blade of the trowel, while the other end is a connection member. The connection member can also be configured in a variety of ways to allow for removable attachment to the rotating mechanism. Examples of configurations can include interference fittings, detents, fasteners, pins, dowels, male and female connections, clamps, magnetic retention and any combination thereof. A preferred embodiment utilizes a female connection on the rotating mechanism, a male connection on the connection member and one or more detents on the handle. These detents interact with matching grooves or holes within the connection member. The male and female connections can be configured in a variety of ways, for example, as standard splines, rectangular in cross section, pentagonal in cross section, hexagonal in cross section, star patterned in cross section, etc. The male and female connections interact with one another to keep the connection member, and thus the application member, in rotary union with the rotating mechanism. The detent is utilized to prevent axial movement, until it is desired to remove the application member from the tool.

Advantageously, the connection member of the tool allows the user to attach and detach the application member to the handle. Therefore, rather than having a kit or collection of different sized tools, the user can have one handle which can attach to a variety of different sized or shaped application members. This allows the user to switch tools by inserting and removing the various desired application members from the handle. Thus an artist can have a vast array of tools which utilize only a single handle. Because the rotating mechanism is contained within the handle, the cost of obtaining additional application members is lower than obtaining additional traditional tools. For example, obtaining ten traditional trowels of different sizes would be more expensive than obtaining a single handle of the current invention and ten application members of various sizes. By concentrating the most expensive components within the handle, the invention advantageously cuts costs by enabling the user to purchase multiple application members which can attach to a single handle. Thus the most expensive component, the handle, is purchased once, whereas the less expensive component, the application member, can be purchased numerous times, depending on the tools the user desires. Hence only the inexpensive component is purchased multiple times, whereas in traditional tools the tool in whole must be purchased every time.

A novel aspect of the trowel of the present invention is the use of a rotating mechanism. A preferred embodiment of the invention utilizes a simple bevel gear set, comprised of two gears and connected to a trigger, shaft and a return spring as the mechanism for rotation. Another preferred embodiment utilizes a hypoid bevel gear set with an offset sufficient to allow the connection member to extend past the gear set. Yet another preferred embodiment utilizes a worm gear set. The shaft is utilized to provide support for the second gear, wherein the shaft is connected to the handle. The trigger may be a separate part from the gears, integral with one of the gears or even remotely connected to one of the gears. Regardless of position, movement of the trigger causes movement of the gear it is connected to. A preferred embodiment has the trigger and the second gear of the gear set as an integral assembly. The first gear within that preferred embodiment is the portion of the rotating mechanism which is removably attached to the connection member, and thus the application member. Additionally, the trigger is limited to a range of displacement. This range allows for rotational limits on the gear set and thus the application member. A preferred range of rotation allows for 180 degrees rotation from the first position of the application member. In a preferred embodiment, this range may be from 0-180 degrees. Another preferred embodiment may have a range of rotation from 270-90 degrees. Yet another preferred embodiment may utilize 45, 135, 225 or 305 as the first position and 225, 305, 45 or 135 degrees, respectively, as the second position. Furthermore, it would be recognized that the first position may be of any angle, so long as the second position of the application member is 180 degrees clockwise or counter-clockwise from the first position. It would also be recognized that the trigger may be centered initially and pushing the trigger away from center and pulling it away from center would result in a total of 180 degrees of rotation for the application member between the fully pushed and fully pulled positions of the trigger. The spring is provided to facilitate the return of the trigger to the first position. The spring may be attached to any one of the gears within the gear set, or the trigger itself, provided that one end is attached to one of the gears or trigger and the other end to the handle. A preferred embodiment has one end of the spring attached to the handle and the other to the first gear.

The handle of the tool serves two main functions. First it provides a user a place to grasp and hold the tool and the second is to enclose the rotating mechanism and to provide support for the rotating mechanism and application member. To facilitate ergonomic holding of the tool, a preferred embodiment of the tool has the handle shaped to provide a comfortable surface to grasp. Another preferred embodiment utilizes grips on the handle to provide the user with a handle that grips to their hand to enable greater control. The grip can also provide a level of comfort, by compressing when the user grasps the handle.

To facilitate the assembly of the tool, a preferred embodiment has the handles divided into halves. This allows the rotating mechanism to fit inside the handle such that when the halves are combined, the rotating mechanism is fully enclosed by the handle. Furthermore, a preferred embodiment includes bosses, which functions as supports. Theses bosses provide a place for the shaft and the connection member to fit into, thus allowing the handle to advantageously support these components. The boss provided to support the shaft supports the second gear of the gear set, while the first gear fits directly into its own boss. Once all components are in place, the halves are brought together, and attached in a variety of ways, such as: fasteners, welding, adhesion, pins, dowels, snap fasteners, interference fittings and any combination thereof. A preferred embodiment utilizes holes on one handle half which are smaller than a screw head but larger than the shank of the screw. The other handle half contains bosses which are dimensioned such that it contains holes in the bosses that are slightly smaller than the shank of a screw. Thus as the halves are brought together, the holes and bosses are aligned. Screws are then used to join the halves by going through the holes and threading into the bosses. Another preferred embodiment utilizes bosses with holes on one half and integral pins on the other half. These pins are dimensioned such that they are slightly larger than the holes in the bosses. When the halves are brought together, this creates an interference fit, thus securely joining the two halves together.

Figure 2:
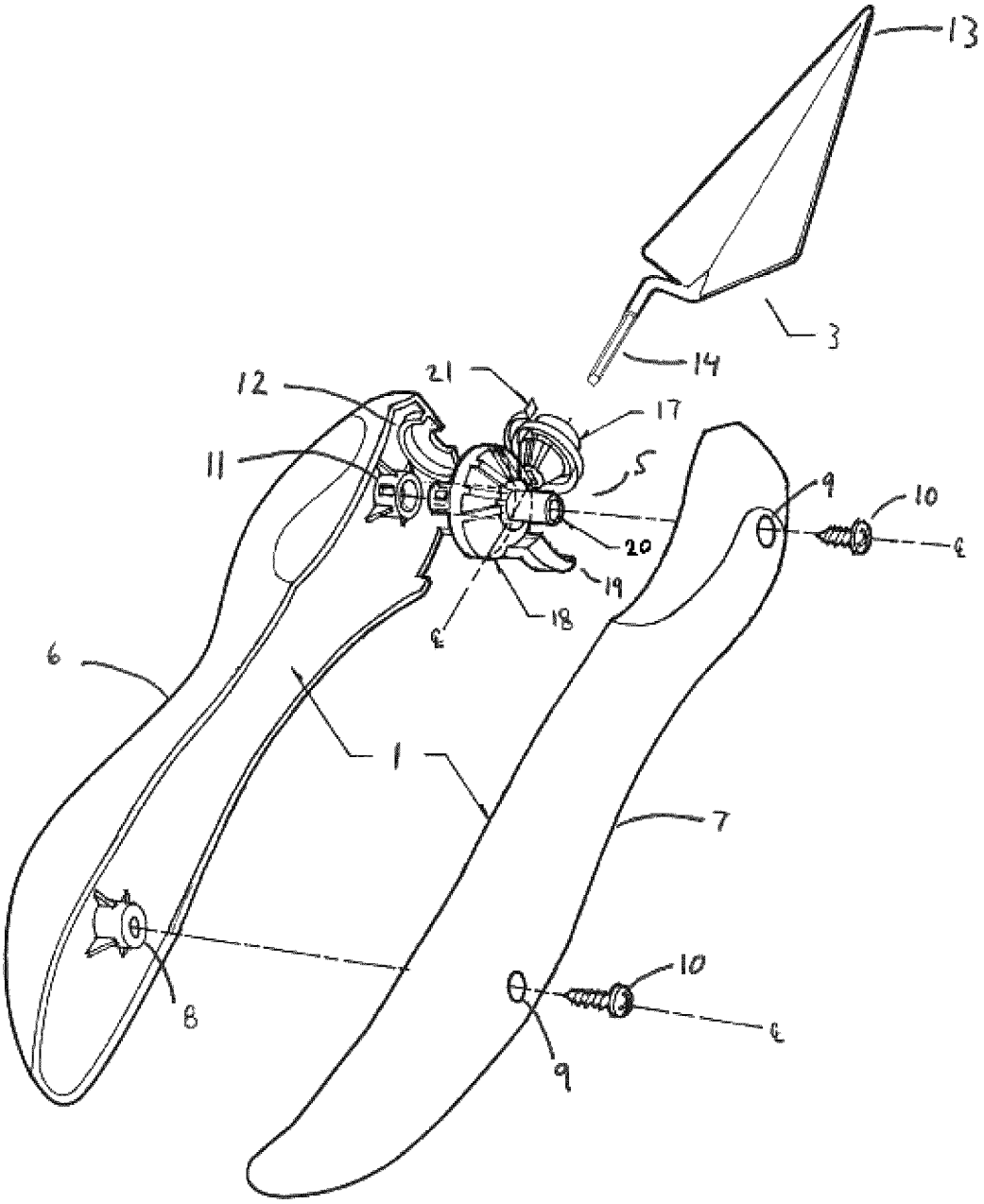
FIG. 2 is an exploded view of the tool showing a preferred embodiment of the handle, rotating component and application member.
Figure 3:
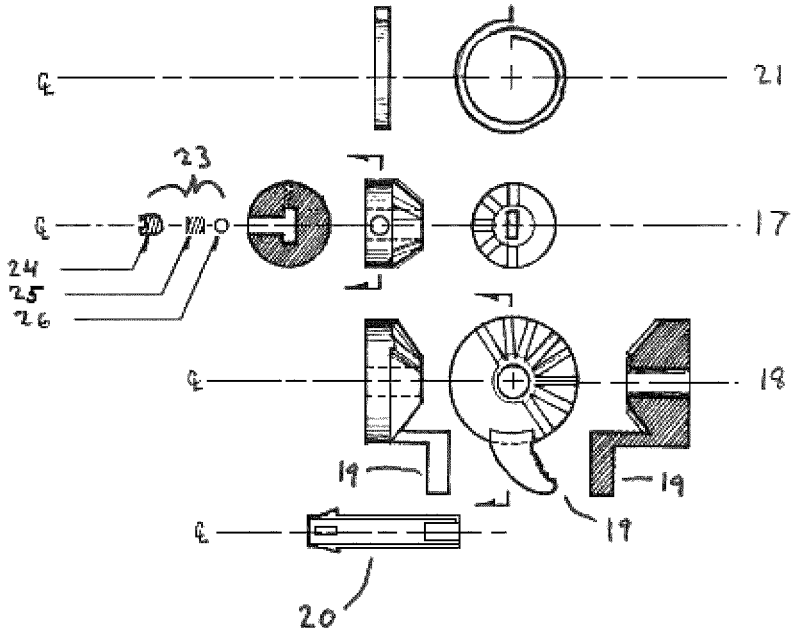
FIG. 3 is an exploded view of the rotating component of the tool of FIG. 2.

FIGS. 2 and 3 are exploded diagrams of a preferred embodiment of the too or trowel. In this embodiment, handle 1 is dived into halves 6 and 7. Handle half 6 contains boss 8 whereas handle half 7 contains holes 9. Boss 8 is dimensioned and configured such that the hole within boss 8 is slightly smaller than the shank of the provided screws 10. Holes 9 are dimensioned and configured such that it is slightly smaller than the heads of screws 10, but larger than the shank of screws 10. Therefore, when the handle halves are brought together, screw 10 engages boss 8 through hole 9. When the head of screw 10 reaches hole 9, the handle halves are securely fastened on one end to one another and are thus partially assembled.

Application member 3 is provided as a painter's trowel in this embodiment. For this embodiment, application member 3 is divided into two ends: end 13 contains the blade of the trowel and end 14 contains a connection member. Connection member 14 may be configured in a variety of ways to enable attachment to rotating mechanism 5. In this embodiment, connection member 14 is provided with a rectangular cross section and a single hole on the broad side of the connection member.

Rotating mechanism 5 in this embodiment comprises of a bevel gear set containing gears 17 and 18, trigger 19, shaft 20 and return spring 21. For this embodiment, trigger 19 and gear 18 are integral components. Return spring 21 is connected on one end to housing 1 and on the other end to gear 17. Rotation of gear 17 deflects spring 21 such that when no force is applied to gear 17, the spring rotates gear 17 back to its original position.

Shaft 20 is provided to support gear 18, with the shaft attaching to housing half 6 at boss 11. Boss 11 and shaft 20 are configured such that when the two are assembled, boss 11 prevents shaft 20 from rotating to allow gear 18 to rotate freely on stationary shaft 20. Such is accomplished by raised protrusions on the shaft and matching holes within boss 11. These protrusions extend past the holes in boss 11, thereby immobilizing shaft 20. Furthermore, shaft 20 is hollow, and dimensioned such that it is slightly smaller in diameter than the diameter of the shank of screw 10. Thus, when handle halves 6 and 7 are brought together, hole 9 is aligned with boss 11, thus allowing screw 10 to thread into boss 11 through hole 9. With screw 10 threaded into boss 8 as detailed above, screws 10 unitize the tool by being fully seated onto holes 9 by being threaded into both boss 8 and 11, thus fully assembling the tool.

Gears 17 and 18 are constrained through contact with one another, as well as through bosses 11 and 12 and shaft 20. Gear 17 is constrained radially by boss 12, in addition to being supported by the boss. Gear 19 is supported by and constrained radially by shaft 20, which is attached to boss 11. As gears 17 and 18 are a bevel gear set, by being in contact with one another, gears 17 and 18 are fully constrained axially. Axial motion of gear 17 is prevented since such movement would cause gear 18 to move radially. As gear 18 is constrained radially by shaft 20, axial movement of gear 17 is prevented. Axial motion of gear 18 is also prevented as this would also cause the radial motion of gear 17, which is constrained radially by boss 12. To ensure constant contact between gears 17 and 18, the bosses are dimensioned such that when the tool is assembled, there is no movement of the gears, other than rotational motion.

Gear 17 of rotating mechanism 5 is dimensioned and configured to receive the application member 3 through removable attachment with connection member 14. In this embodiment, a rectangular cross section hole is provided in gear 17, with the hole being sufficiently large enough to allow connection member 14 to slide in with minimal force yet small enough to allow for rotary union with connection member 14. Detent 23 is also provided within gear 17, which enables the connection member to be axial immovable when detent 23 is engaged. Detent 23 is composed of set screw 24, spring 25 and ball bearing 26. Set screw 24 is provided to adjust the pressure on ball bearing 26. When connection member 14 is inserted into gear 17, this moves ball bearing 26 and disengages the detent. The displacement of ball bearing 26 by connection member 14 is then accommodated by spring 25. When the hole in connection member 14 is aligned with ball bearing 26, spring 25 forces ball bearing 26 into the hole on connection member 14, thus engaging the detent. As ball bearing 26 is placed within the hole of connection member 14, application member 3 becomes axially immovable to gear 17, and thus rotating mechanism 5. Retracting application member 3 from rotating mechanism 5 is enabled by detent 23. When sufficient force is applied to connection member 14, ball bearing 26 is moved out of the hole in connection member 14, thus disengaging detent 23 and allowing application member 3 to be removed.

Figure 4:
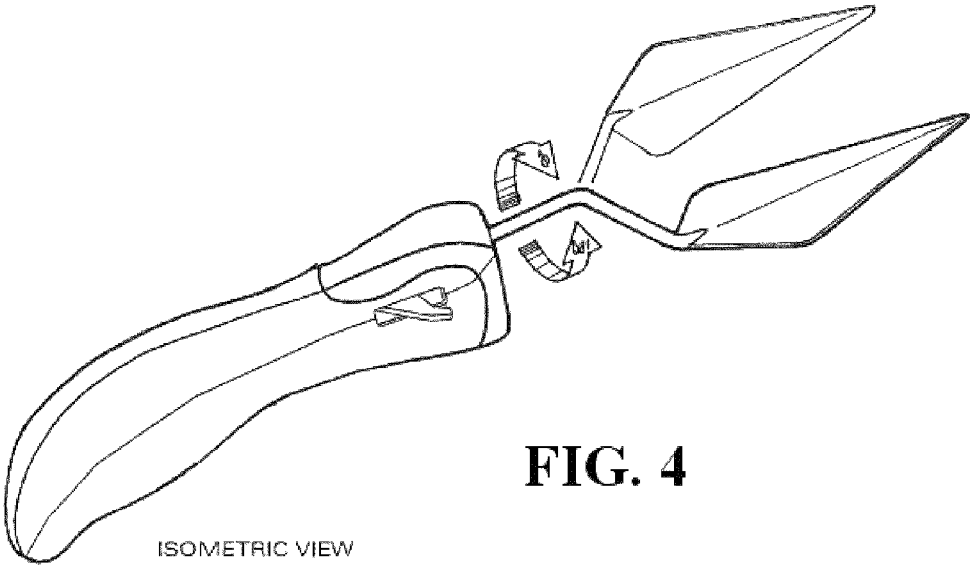
FIG. 4 is an isometric view of a preferred embodiment of the assembled tool, displaying the range of motion for the tool.
Figure 5:
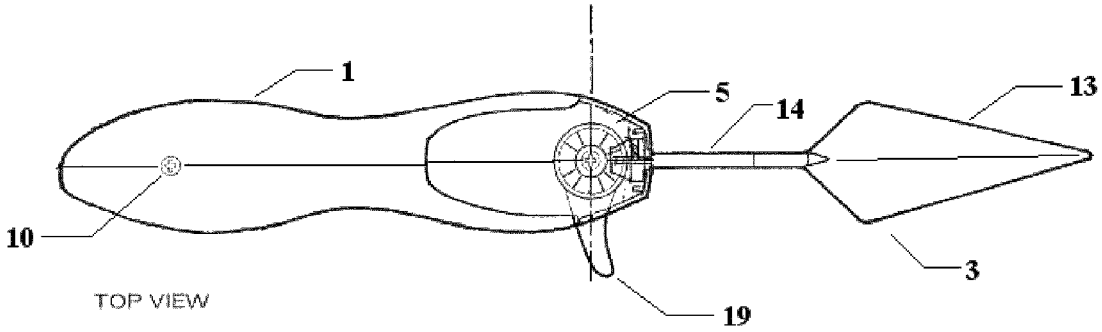
FIG. 5 is a top view of a preferred embodiment of the assembled tool, with a transparent portion to demonstrate a preferred embodiment of the rotating mechanism.

FIG. 4 illustrates the rotation of the application member 3 when the trigger 19 is engaged. As shown therein, the back side of the trowel picks up the paint from the palette, with the artist then depressing the trigger so that the trowel is rotated 180 degrees, for example from 9 o'clock to 3 o'clock. Then the artist is able to apply the paint as a panel upon the canvas or other support member. After that action is completed, the trigger is released and the spring within the rotating mechanism returns the trowel to its initial position, ready to pick up additional paint from the palette. FIG. 5 illustrates the orientation of the trowel and handle when viewed from the top.

Figure 6:
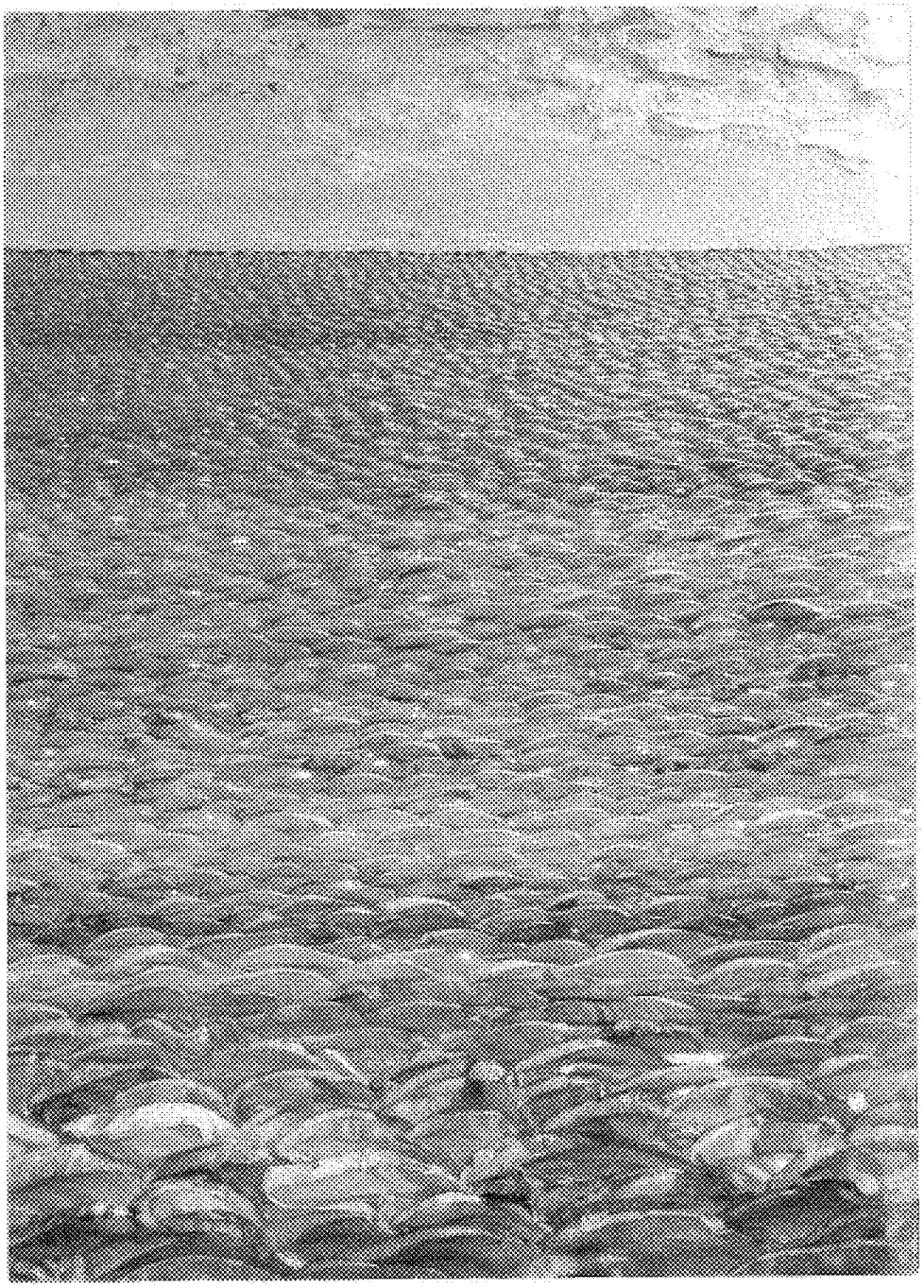
FIG. 6 is an illustration of a painting prepared according to the invention.

FIG. 6 is a view of the final painting of an ocean after being prepared as noted herein. As shown in FIG. 6, the increasing thickness of the paint panels in the lower rows is quite evident, along with the unusual and interesting depiction that results.

As different size trowels are used during the application of the paint utilizing the method above, it is useful to collect a plurality of different size trowels and provide them in a kit for the convenience of the artist in preparing the painting. The kit would also include sufficient image creating material to create an artistic work.

An embodiment of the kit of the invention comprises a plurality of trowels of various sizes, a single handle and image creating material. A preferred embodiment contains 2 to 8 trowels of various sizes which are interchangeable with the single handle. For the image creating material, paints, clay, plaster of paris or similar materials of various colors can be used as the image creating material. Further embodiments of the kit can include instructions. These instructions may be written instructions, audio instructions, or video instructions. The invention may also provide any combination of instructions, such as written and video or video and audio. This will enable an artist who is otherwise unfamiliar with the present invention to be able to create three-dimensional artistic objects.

The trowels within the kit can be of any type. A preferred embodiment includes traditional trowels within the kit. Another preferred embodiment includes a rotating mechanism within the traditional trowels. This rotating mechanism includes a trigger and a gear set, with the trigger operatively associated with a gear within the gear set and the trowel blade in rotary union with another gear in the gear set. Yet another preferred embodiment of the kit provides for a single trowel handle and various size trowel blades. These blades are removably attached to the single handle. Furthermore, it is within the scope of this invention to also provide the rotating mechanism as described above in this handle. The painting or sculpting tool as detailed above may also be provided in the kit in trowel form.

While the novel trowel and kit of trowels of the present invention have been described herein for use as painting or sculpturing tools, a skilled artisan would immediately recognize that these trowels and kits can also be used in other fields such as in the bakery field for use in handling bread or cookie doughs, in the masonry field as a cement for mortar trowel, or in other fields where semisolid or workable material is to be provided upon a surface. Thus, the trowels of the invention are not to be limited to use in the painting or sculpturing methods of the present invention.

What is claimed is:

1. A method for creating a three-dimensional artistic creation on a support member, which comprises:

distributing an image creating material on a palette at a first substantially uniform thickness;

removing first portions of the first thickness of image creating material and applying such first portions across a first path along and onto the support member with pressure and twisting movement such that the first portions form a first plurality of deposited panels that contact each other along the path and protrude from the support member at a thickness that is greater than that of the material on the palette;

distributing further image creating material on a palette at a second substantially uniform thickness that is greater than that of the first substantially uniform thickness; and removing second portions of the second thickness of image creating material and applying such second portions across a path along and onto the support member with pressure and twisting movement such that the second portions are applied to protrude from the support member and form a second plurality of deposited panels that contact each other along the path with each having a thickness that is greater than that of the material on the palette as well as that of the first portions to provide three-dimensional features of the creation.

2. The method of claim 1, which further comprises depositing the panels sequentially with the second plurality of panels being deposited subjacent to and after the depositing of the first plurality of panels and in a desired pattern to provide three dimensional characteristics to the creation.

3. The method of claim 1, wherein the distributing and removing steps are repeated for additional pluralities of panels with increasing thicknesses of image creating material on the palette and with application of further portions for each additional plurality so that the further portions in each panel protrude from the support member at thicknesses that are greater than that of previously applied portions to further provide three-dimensional features of the creation, wherein the first panels are applied to the support member using a small trowel and as the second and further panels of greater thickness are applied, larger trowels are used for ease of application of the image creating material.

4. The method of claim 3, wherein the greater thicknesses of material are applied using successively larger tools to more easily apply the materials to the support member.

5. The method of claim 1, wherein the second portions are applied subjacent the first portions and aligned therewith, and which further comprises applying the second portions at least partially upon the previously applied first portions to further enhance the three-dimensional features of the creation.

6. The method of claim 1, wherein the image creating materials include an oil-based artist's paint, acrylic-based artist's paint, a thermosetting polymeric material, plaster of paris or a modeling clay, optionally containing a filler comprising talc, colloidal silica or another inorganic material.

7. The method of claim 1, wherein the image creating material is applied to the palette and support member with a tool comprising a handle enabling a user to hold the tool; a rotating mechanism supported by the handle; and an application member removably attached to and in rotary union with the rotating mechanism, wherein the tool includes a trigger for engaging the rotating mechanism and a spring for re-loading the trigger after engagement and release to facilitate application of the image creating material, and wherein the application member is removable such that different size application members can be sequentially connected to the handle and used to sequentially apply greater amounts of material.

8. The method of claim 1, wherein the applying of the first portions onto the support member is facilitated by a tool selected from a kit, wherein the kit includes at least one tool comprising a plurality of trowels with various size blades and at least one handle for the trowels.

9. The method of claim 8, wherein the kit comprises 2 to 8 trowel blades of different size blades each mounted on a separate handle or which are interchangeably mountable on a single handle.

10. The method of claim 9, wherein the kit further comprises a supply of image creating material and instructions for carrying out the method steps to create an image or artistic work, wherein the instructions are provided in written form, audio form, video form and any combination thereof.

11. The method of claim 10, wherein the instructions include steps for repeating the distributing and removing steps to apply further portions of image creating material in additional pluralities of panels so that the further portions in each additional panel protrude from the support member at thicknesses that are greater than that of previously applied portions of other panels to provide further three-dimensional features of the creation.

12. The method of claim 11, wherein the handle of the tool(s) in the kit includes a rotating mechanism comprising a trigger which is operatively associated with a gear set, wherein each blade of the trowel is configured for attachment to and in rotary union with another gear within the gear set, such that movement of the trigger rotates the trowel blade.

13. The method of claim 11, wherein the handle of the tool(s) in the kit is hollow and encloses the rotating mechanism at least partially or fully therein, with the rotating mechanism comprising a gear set having a first gear that is configured and dimensioned to receive the trowel; and a second gear operatively associated with the first gear for rotating the first gear.

14. The method of claim 10, wherein the image creating material in the kit comprises paint, clay, polymeric materials, plaster of paris, similar materials, or combinations thereof, optionally with the materials having different colors for creating a desired scene is paint of various colors, wherein the material is an oil-based artist's paint combined with a thermosetting polymeric material and a filler comprising talc, colloidal silica or another inorganic material, or is an acrylic-based artist's paint combined with a thermosetting polymeric material and a filler comprising talc, colloidal silica or another inorganic material.

15. A method for creating a three-dimensional artistic creation on a support member, which comprises:

distributing an image creating material on a palette at a first substantially uniform thickness;

removing first portions of the first thickness of image creating material and applying such first portions across a first generally horizontal path along and onto the support member with pressure and twisting movement such that the first portions form deposited panels that protrude from the support member at a thickness that is greater than that of the material on the palette;

distributing further image creating material on a palette at a second substantially uniform thickness that is greater than that of the first substantially uniform thickness;

removing second portions of the second thickness of image creating material and applying such second portions across a second generally horizontal path along and onto the support member with pressure and twisting movement such that the second portions are applied to protrude from the support member a thickness that is greater than that of the material on the palette as well as that of the first portions to provide three-dimensional features of the creation; and providing guide lines upon the support member for assisting in the application of the materials along the paths, wherein the guide lines include one or more generally horizontal lines, and, optionally, two or more generally vertical or angled lines or combinations of generally horizontal, generally vertical or angled lines.

16. A method for creating a three-dimensional artistic creation on a support member, which comprises:

distributing an image creating material on a palette at a first substantially uniform thickness;

providing guide lines upon the support member for assisting in the application of the image creating materials upon paths, wherein the guide lines include one or more generally horizontal lines, and, at least two angled lines the ends of which are spaced closer together in an upper portion of the support member and the opposite ends of which are spaced further apart in a lower portion of the support member;

removing first portions of the first thickness of image creating material and applying such first portions across a first path along and onto the support member with pressure and twisting movement such that the first portions form deposited panels that contact each other along the path and protrude from the support member at a thickness that is greater than that of the material on the palette;

distributing further image creating material on a palette at a second substantially uniform thickness that is greater than that of the first substantially uniform thickness; and removing second portions of the second thickness of image creating material and applying such second portions across a path along and onto the support member with pressure and twisting movement such that the second portions are applied to contact each other along the path and protrude from the support to form additional deposited panels of relatively uniform thicknesses with each having a thickness that is greater than that of the material on the palette as well as that of the first portions to provide three-dimensional features of the creation;

wherein the first panels are applied to the support member using a small trowel and the additional panels of greater thickness are applied using a larger trowel for ease of application of the image creating material.

17. The method of claim 16, wherein the image creating materials include an oil-based artist's paint, acrylic-based artist's paint, a thermosetting polymeric material, plaster of paris or a modeling clay, optionally containing a filler comprising talc, colloidal silica or another inorganic material.

18. The method of claim 16, which further comprises providing a supply of image creating material and instructions for carrying out the method steps to create an image or artistic work, wherein the instructions are provided in written form, audio form, video form and any combination thereof.

19. The method of claim 16, wherein the applying of the portions onto the support member is facilitated by a tool selected from a kit, wherein the kit includes at least one tool comprising a plurality of trowels with various size blades and at least one handle for the trowels.

20. The method of claim 19, wherein the kit comprises 2 to 8 trowel blades of different size blades each mounted on a separate handle or which are interchangeably mountable on a single handle, wherein the larger trowel blades are used to deposit the subsequent and larger panels.

* * * * *

UNITED STATES PATENT AND TRADEMARK OFFICE

CERTIFICATE OF CORRECTION

PATENT NO. : 9,085,195 B2
APPLICATION NO. : 13/291617
DATED : July 21, 2015
INVENTOR(S) : Mesaros It is certified that error appears in the above-identified patent and that said Letters Patent is hereby corrected as shown below:

IN THE CLAIMS

Column 12:
Line 54, after "configured and dimensioned to receive the", delete "trowel;" and insert
-- application member; --.

Signed and Sealed this
Tenth Day of November, 2015

Michelle K. Lee

Michelle K. Lee
*Director of the United States Patent and Trademark Office*